United States Patent [19]

Inoue et al.

[11] 4,366,473

[45] Dec. 28, 1982

[54] CAPACITIVELY COUPLED ELECTROMAGNETIC INTRUSION WARNING SYSTEM

[75] Inventors: Hiromitsu Inoue, Kyoto; Hiroshi Ohashi, Hirakata; Yuji Takada, Neyagawa, all of Japan

[73] Assignee: Matsushita Electric Works, Ltd., Kadoma, Japan

[21] Appl. No.: 221,818

[22] Filed: Dec. 31, 1980

[30] Foreign Application Priority Data

| | | | |
|---|---|---|---|
| Jan. 15, 1980 | [JP] | Japan | 55-3327 |
| Jan. 15, 1980 | [JP] | Japan | 55-3328 |
| Jan. 15, 1980 | [JP] | Japan | 55-3330 |
| Jan. 15, 1980 | [JP] | Japan | 55-3331 |
| Jul. 28, 1980 | [JP] | Japan | 55-102378 |

[51] Int. Cl.[3] ..... G08B 13/26

[52] U.S. Cl. ..... 340/562; 340/564

[58] Field of Search ..... 340/562, 564

[56] References Cited

U.S. PATENT DOCUMENTS

| | | | |
|---|---|---|---|
| 3,764,861 | 10/1973 | Orris | 340/562 |
| 4,064,499 | 12/1977 | Geiszler et al. . | |
| 4,174,518 | 11/1979 | Mongeon | 340/564 |

*Primary Examiner*—Glen R. Swann, III

*Attorney, Agent, or Firm*—Cushman, Darby & Cushman

[57] ABSTRACT

An intrusion warning system for indicating the presence of an intruder to a given area comprises a single antenna line encircling the area insulated from the ground, a high frequency oscillator (e.g. of 1 kHz to 10 kHz) for feeding a high frequency signal to the antenna, a coupling impedance, for example, a capacitor, connected between the output terminal of the oscillator and the antenna, and a signal processing part which produces an alarm when detecting a voltage change over a predetermined level of the antenna induced by a proximation of the intruder.

7 Claims, 32 Drawing Figures coupling impedance
2
A
4
B
input impedance
Zc
3
amplifier
7
detector
8
81
bandpass filter
9
D
threshold circuit
10
E
5
alarm circuit
6
oscillator
1
oscillating circuit
15
L
frequency switching control
14
J
threshold circuit
13
I
beat detector
12
G
mixer
11
A
19
A.C. power source $f_{o2}$
$f_{o1}$
frequency 15'
1
oscil-lation circuit ($f_{01}$)
oscil-lation circuit ($f_{02}$)
15''
152
mixer
2
coupling imped-ance
input impedance
3
4
5
7
amplifier
8
detector
9
bandpass filter
10
threshold circuit
7'
amplifier
8'
detector
9'
bandpass filter
10'
threshold circuit
28
AND circuit
6
alarm circuit $f_{o2}$
$f_{o1}$
frequency

CAPACITIVELY COUPLED ELECTROMAGNETIC INTRUSION WARNING SYSTEM

BACKGROUND OF THE INVENTION

1. Field of the Invention

The present invention relates to an intrusion warning system utilizing an antenna on which an A.C. voltage is impressed.

2. Description of the Prior Art

FIG. 1(*a*) is a block diagram showing an example of the conventional intrusion warning system utilizing an electric field, such as shown in the U.S. Pat. No. 4,064,499. In the system of FIG. 1(*a*), a voltage of a high frequency, for example, about 9750 Hz shown by FIG. 2(E) and generated by a signal generating circuit E is applied across a field wire S and the ground, and a voltage change induced on an antenna A disposed with a substantially uniform distance gap g from the field wire S is detected and processed to produce an intruder detecting signal. The voltage change due to the intruder is detected as follows:

Provided that a resistance between the antenna and the ground, i.e. an input impedance of the amplifier is sufficiently large, by considering the equivalent circuit of FIG. 1(*b*), the induced voltage V, for the case that there is no intruder, is given by:

$$V = \frac{C_{1'}}{C_{1'} + C_o} \cdot e, \tag{1}$$

wherein $C_1'$ . . . is a capacitance between the field wire S and antenna A, $C_o$ . . . is a capacitance between the antenna A and the ground, e . . . is a voltage of the high frequency signal applied to the field wire S.

Then, by considering the intruder's body as an electric conductor, and capacitance between the intruder's body and the antenna A is $C_M$, the induced voltage $V_a'$ becomes as shown by the following equation (2):

$$V'_a = \frac{C_{1'}}{C_{1'} + C_o + C_M} \cdot e \tag{2}$$

The induced voltage is amplified by an amplifier 7, then detected by a detection after circuit 8. After passing a band-pass filter 9 the voltage is provided to a threshold circuit 10, where its input value $V_a$ is compared with a predetermined threshold value $V_{th}$.

When a man passes through the electric field of the antenna A as shown by FIG. 1(*c*), the induced voltage $V_a'$ changes as shown by FIG. 2($V_a'$) by the change of capacitance $C_M$, and therefore, the input voltage $V_a$ to the threshold circuit 10 changes as shown by FIG. 2($V_a$) and by FIG. 1(*d*). Therefore, when the input voltage $V_a$ becomes lower than the predetermined threshold value $V_{thL}$ at the time $t_1$ as shown by FIG. 2($V_a$), the threshold circuit 10 sends an output signal to the warning circuit 6, which issues a warning signal at the time $t_1$ as shown by FIG. 2($V_s$), to light a lamp or ring a buzzer.

Such a conventional intruder detection system uses two wires S and A, and therefore when a strong wind blows, the gap between the two wire is likely to change considerably, thereby producing undesirable change of the capacitance $C_1$ between the two wires, and therefore, false alarms are likely to be issued. Furthermore, when the area to be protected is broad, it is expensive to install two wires with a uniform gap and also is sometimes difficult due to the contours of the land.

Furthermore, the sensitivity of the detection is greatly influenced by changes of the capacitance $C_o$ between the antenna wire S and the ground which is dependent on the length of the antenna wire S and height of the antenna wire S from the ground. Therefore, the conventional system has had a problem that the apparatus can not be as sensitive as designed, since the design is made for an average antenna wire of average height and length, or in other words, the apparatus is useful only when the antenna is in a limited range of height and length. Moreover providing a pair of wires may be difficult in practice because of surrounding conditions.

In addition, the conventional system has a further problem that false alarms are likely to be caused by interference or beating between the high frequency signal fed to the antenna and a high harmonic of the frequency of the A.C. power existing in the protected area. Such beating produces a signal of a very low frequency such as 0.1 to 2 Hz and such low frequency signal passes the band-pass filter 9 and causes the alarm circuit 6 to produce a false alarm. In order to avoid such false warning, in U.S. Pat. No. 4,064,499, the oscillation frequency of the signal to be fed to the antenna is locked by a complicated frequency lock circuit or the alarm output is disabled by utilizing an output of a beat frequency detector circuit (BFD) when the A.C. power frequency produces the abovementioned undesirable beating. However, if the first measure, using the frequency lock circuit (FLC) is employed, the increased complication of the circuitry increases the cost of the system and if the second measure, disabling the alarm, is employed intruder detection is often disabled.

SUMMARY OF THE INVENTION

The present invention solves the abovementioned problems of the conventional intrusion warning system.

The system in accordance with the present invention employs only a single wire around the protected area, thereby reducing the cost of the system and also reducing false alarms. The present invention can perform the intrusion sensing with high sensitivity regardless of variation of the length or height of the antenna wire and can provide a reliable protection without disabled periods in the system regardless of variation of the power source frequency, without complicated circuit.

BRIEF DESCRIPTION OF THE DRAWINGS

FIG. 1(*b*) is an equivalent circuit of the system of FIG. 1(*a*).

FIG. 1(*c*) is a schematic chart illustrating the passing of a man under an antenna of the system.

FIG. 1(*d*) is a graph showing change of input signal to an amplifier 7 of FIG. 1(*a*) in relation to the positions in FIG. 1(*c*).

FIGS. 3(*b*), (*c*) and (*d*) are circuit diagrams showing examples of the coupling impedance 2 of FIG. 3(*a*).

FIGS. 3(*e*), (*f*) and (*g*) are circuit diagrams showing examples of the input impedance 3 of FIG. 3(*a*).

FIG. 4(*b*) is a schematic chart illustrating the passing of a man under an antenna of the system of the present invention.

FIG. 4(*c*) is a graph showing change of input signal to an amplifier 7 of FIG. 3(*a*) in relation to the positions in FIG. 4(*b*).

FIG. 17(*b*) is a sectional elevation view of the antenna cap of FIG. 17(*a*).

DESCRIPTION OF THE PREFERRED EMBODIMENT

Figure 3:
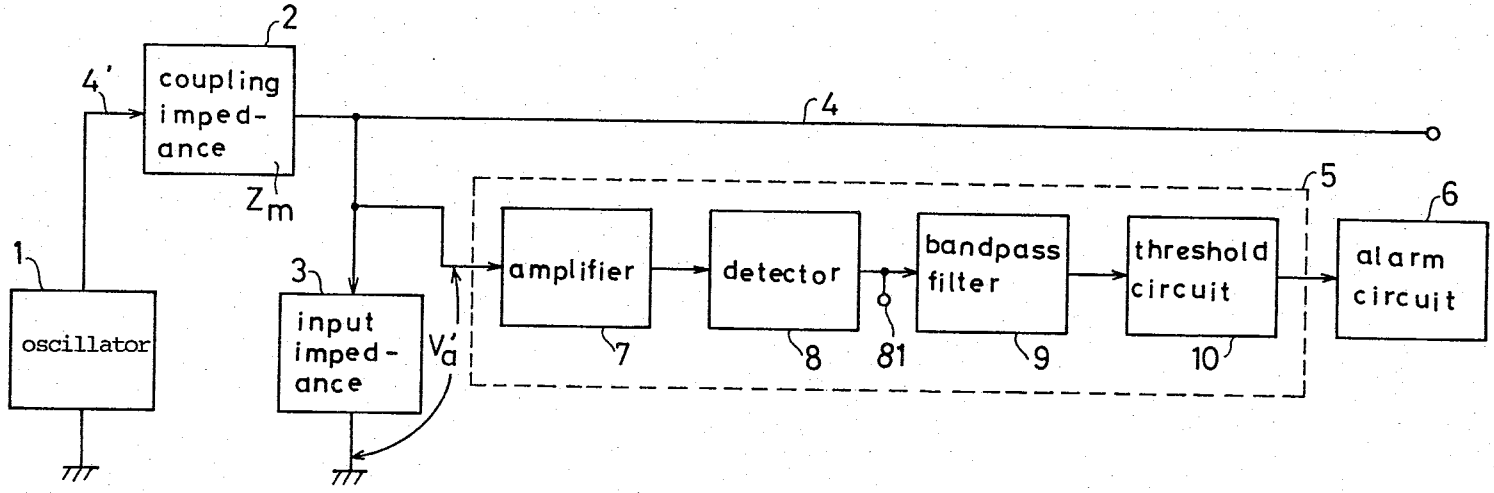
FIG. 3(*a*) is a block diagram of an example embodying the present invention.
Figure 3:
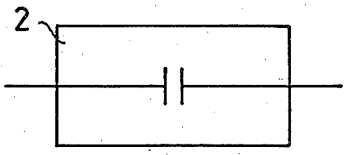
Figure 3:
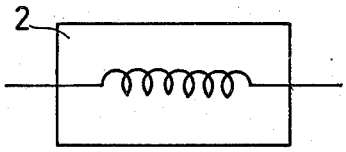
Figure 3:
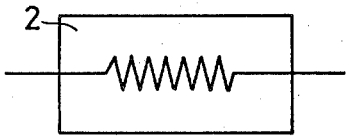
Figure 3:
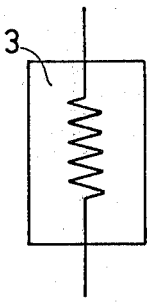
Figure 3:
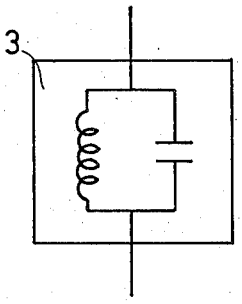
Figure 3:
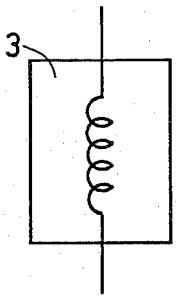

Hereafter the present invention is elucidated in detail referring to the drawing FIG. 3(*a*) and thereafter showing examples embodying the present invention. In FIG. 3(*a*), which shows a block diagram of a first example of the present invention, an antenna 4 is connected through a coupling impedance 2 to a high frequency oscillator 1, so that the high frequency current from the oscillator 1 is fed to the antenna 4 through the coupling impedance 2. An input impedance 3 is connected across the antenna 4 and the ground, and the high frequency voltage across the input impedance 3 is input to the signal processing part 5, which comprises an amplifier 7, a detector 8, a band-pass filter 9 of very low pass-band frequency such as 0.08 to 0.3 Hz, a threshold value detection circuit 10 and an alarm circuit 6.

The coupling impedance 2 is, for example, a capacitor, an inductance, or a resistance and concerning the value thereof a detailed explanation will be given later. For the input impedance 3, either a high resistance or such high impedance circuit as a parallel connected LC resonance circuit which has a resonance frequency substantially equal to the frequency of the oscillator 1 may be employed.

Now, provided that the impedance between the antenna 4 and the ground is sufficiently large, the induced voltage V for the case that there is no intruder is given by $$V = \frac{C_1}{C_1 + C_o} \cdot e \tag{3}$$

wherein $C_1$ . . . is the capacitance of the coupling impedance 2, $C_o$ . . . is a capacitance between the antenna 4 and the ground, e . . . is a voltage of the high frequency signal fed from the oscillator 1.

Then, by considering the intruder's body as an electric conductor, and capacitance between the intruder's body and the antenna 4 is $C_M$, the induce voltage $V_a'$ becomes as shown by the following equation (4):

$$V'_a = \frac{C_1}{C_1 + C_o + C_M} \cdot e. \tag{4}$$

The induced voltage $V_a'$ is amplified by an amplifier 7, then detected by a detection circuit 8, and after passing a band-pass filter 9 led to a threshold circuit, where its input value $V_a$ is compared with a predetermined threshold value $V_{thL}$.

Figure 4:
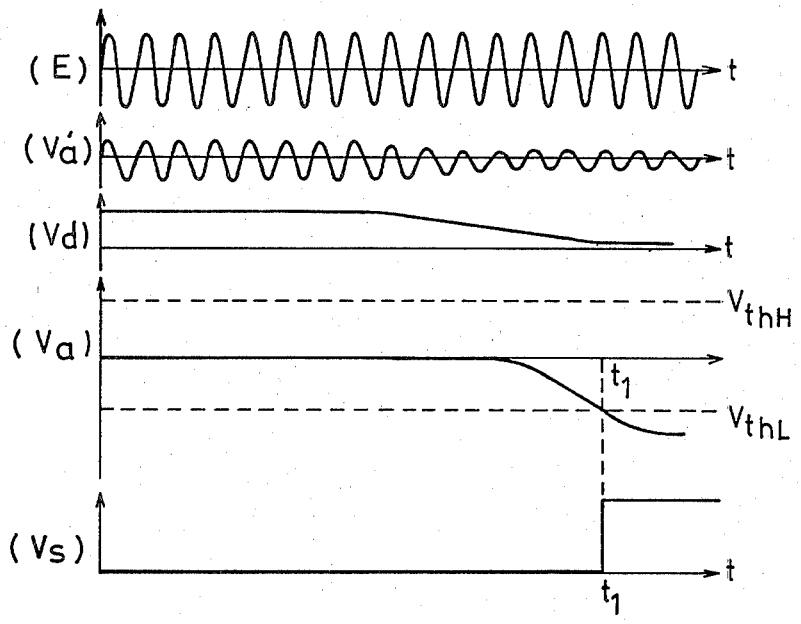
FIG. 4(*a*) is a waveform chart showing waveforms of electric signals at various parts of the system of FIG. 3(*a*).
Figure 4:
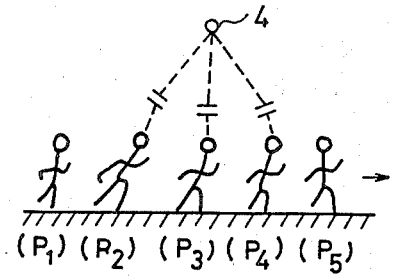
Figure 4:
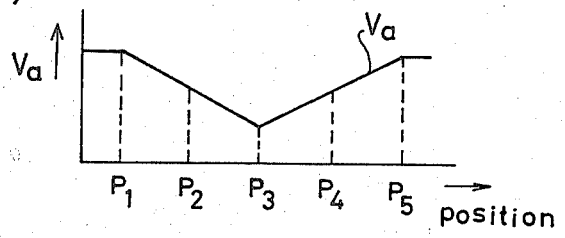

When a man passes through the electric field of the antenna 4 as shown by FIG. 4(*b*), the induced voltage changes as shown by FIG. 4(*c*) by the change of the capacity $C_M$, and therefore, the input voltage $V_a$ to the threshold circuit 10 changes as shown by FIG. 4(*a*)($V_a$) and FIG. 4(*c*). Therefore, when the input voltage $V_a$ becomes lower than the predetermined threshold value $V_{thL}$ at the time $t_1$ as shown by FIG. 4($V_a$), the threshold circuit 10 sends an output signal to the warning circuit 6, which issues a warning signal at the time $t_1$ as shown by FIG. 4(*a*)($V_s$), to light a lamp or ring a buzzer.

Figures 1A, 1B, 1C, 1D:
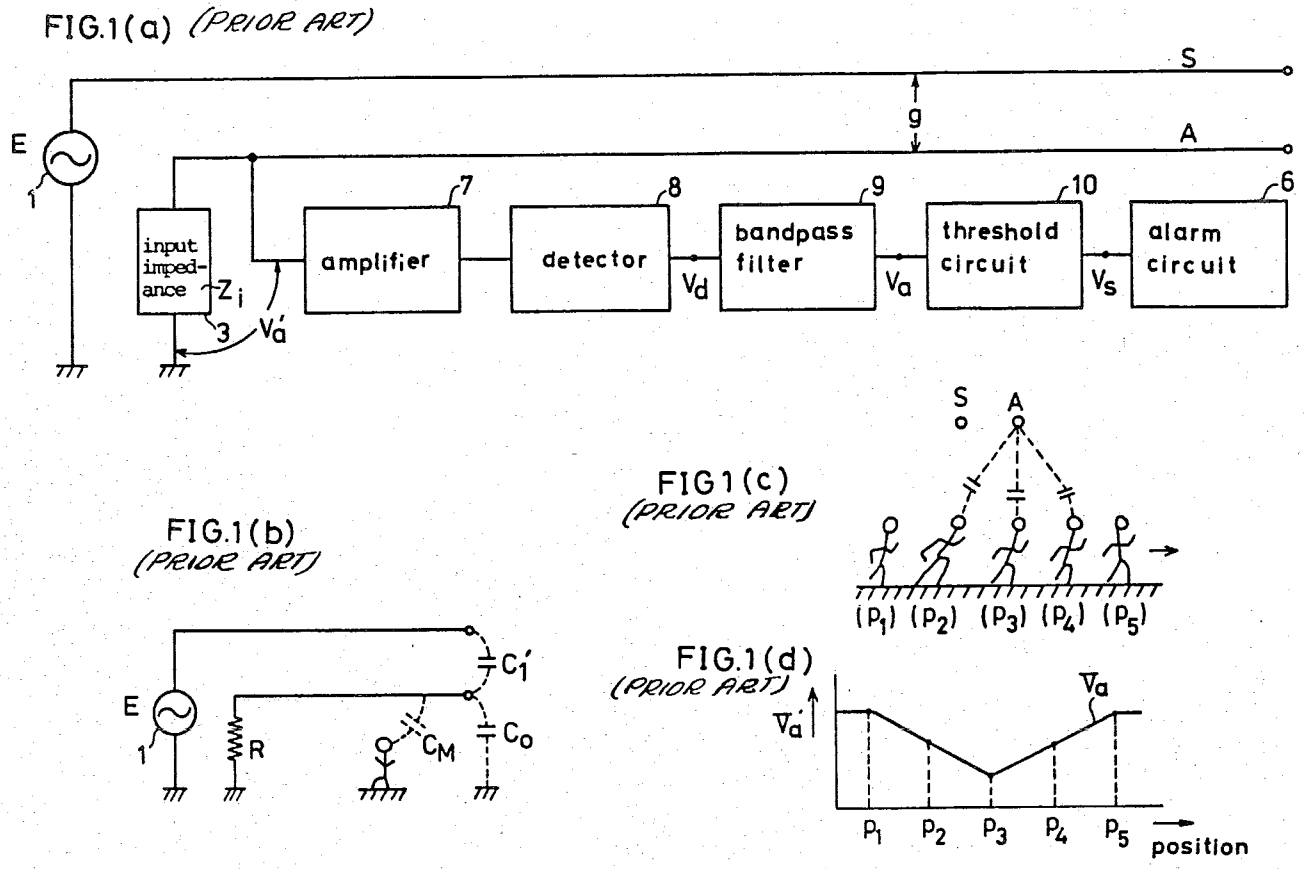
FIG.1(a) (PRIOR ART)
FIG.1(b) (PRIOR ART)
FIG1(c) (PRIOR ART)
FIG.1(d) (PRIOR ART)
FIG. 1(*a*) is a block diagram of an example of the conventional intrusion warning system.
Figure 2:
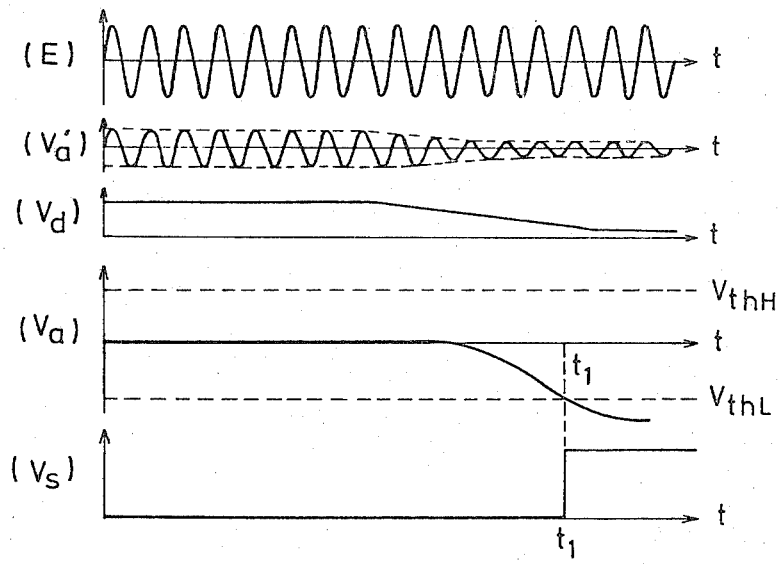
FIG. 2 (PRIOR ART)
FIG. 2 is a waveform chart showing waveforms of electric signal at various parts of the system of FIG. 1(*a*).

The equation (3) and (4) are substantially the same as those of (1) and (2) as can easily be understood. Therefore, it is obvious that, in the same way as by the conventional system of FIG. 1(*a*), it is possible to detect the intruder through a voltage change of the antenna 4, which is a single field wire in the present invention. Since only a single antenna wire is used, there is no problem that a strong wind causes undesirable variation of wire-to-wire gap between parallel wires, and the cost of construction of the system is reduced. The only construction consideration is to keep the height of the wire uniform above the ground. Furthermore the single wire antenna system is less sensitive to undesirable vibration by the wind than the conventional two wire system, and accordingly there is a smaller possibility of false alarms.

For the coupling impedance 2, other impedances such as an inductance as shown in FIG. 3(*c*), a resistance as shown in FIG. 3(*d*), and a composite impedance formed by connecting a capacitance, inductance and resistance can be used.

For the input imedpance 3, a high resistance as shown by FIG. 3(*e*) is ordinary used. However, other input impedances, for example, a parallel resonance circuit as shown by FIG. 3(*f*) or an inductance as shown by FIG. 3(*g*) can be used. In case the input impedance of FIG. 3(*f*) is used, its resonant frequency is preferably selected close to or substantially the same as that of the oscillation frequency of the high frequency oscillator 1, so that the change of the input signal to the amplifier at the detection of the intruder is very sharp by means of the sharp gradient of the resonance curve thereby providing a high sensitivity.

It is also possible to provide additional antenna wire(s) 4″ which is(are) connected in series with additional coupling impedance(s), by connecting to a single common high frequency oscillator 1 and connected to an additional signal processing part.

Figures 5, 8:
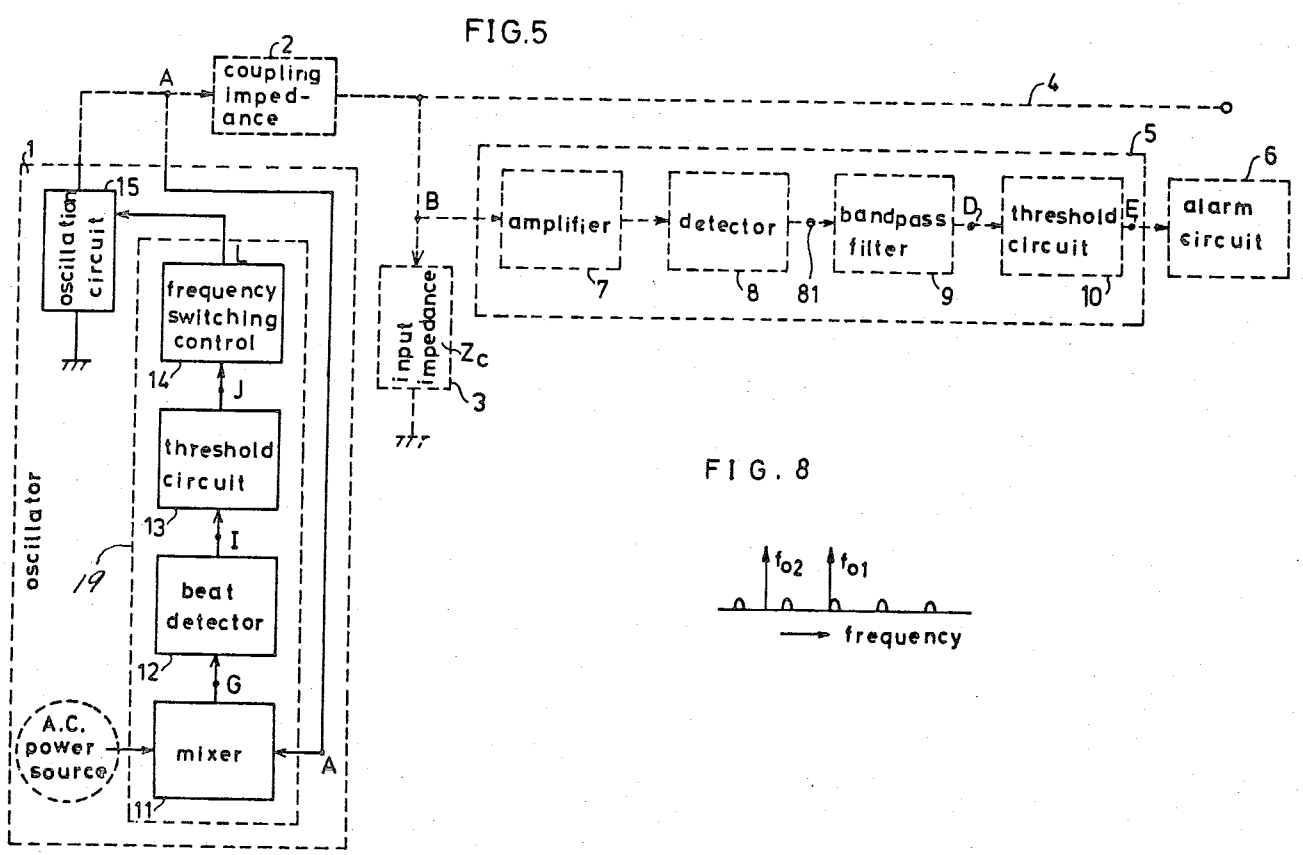
FIG. 5 is an example showing detailed structure of the oscillator 1 of FIG. 3(*a*), with relevant parts in dotted lines.
FIG. 8 is a frequency spectrum chart for illustrating the beat.

FIG. 5 shows a first example of the oscillator 1 with which the intrusion alarm system can attain a high stability againt the electric field from harmonics of a commercial A.C. power source, so that the system does not issue false alarms due to beating produced between the higher harmonics and the oscillated signal. Oscillation circuit 15 in FIG. 5 can oscillate at two different frequencies controlled by a frequency switching control voltage applied thereto, and a beat detector block 19 which detects an occurrence of low frequency beating and issues the control signal to be applied to the oscillation circuit 15.

The beat detector block 19 comprises a mixer 11, a detector circuit 12 including a band-pass filter, a threshold circuit 13 and a frequency switching control circuit 14 in this order, and gives the frequency switching control signal to the oscillation circuit 15. The mixer circuit 11 mixes the commercial A.C. power current and the high frequency output signal of the oscillation circuit 15 and issues the mixed signal i.e., reference beat signal between the harmonics of the A.C. power current and the high frequency output signal. The detector circuit 12 including the band-pass filter rectifies the mixed signal i.e., reference beat signal from the mixer circuit 11. The beat threshold circuit 13 issues an output signal when the beat frequency becomes low and hence the output signal of the detector circuit 12 becomes larger than a predetermined level. The frequency switching control circuit 14 is a circuit to issue output signal of H or L level and is composed, for example, of a T-type flip-flop circuit driven by the output signal of the beat threshold circuit 13 and a comparator which issues the frequency switching control signal to the oscillation circuit 15.

Figure 6:
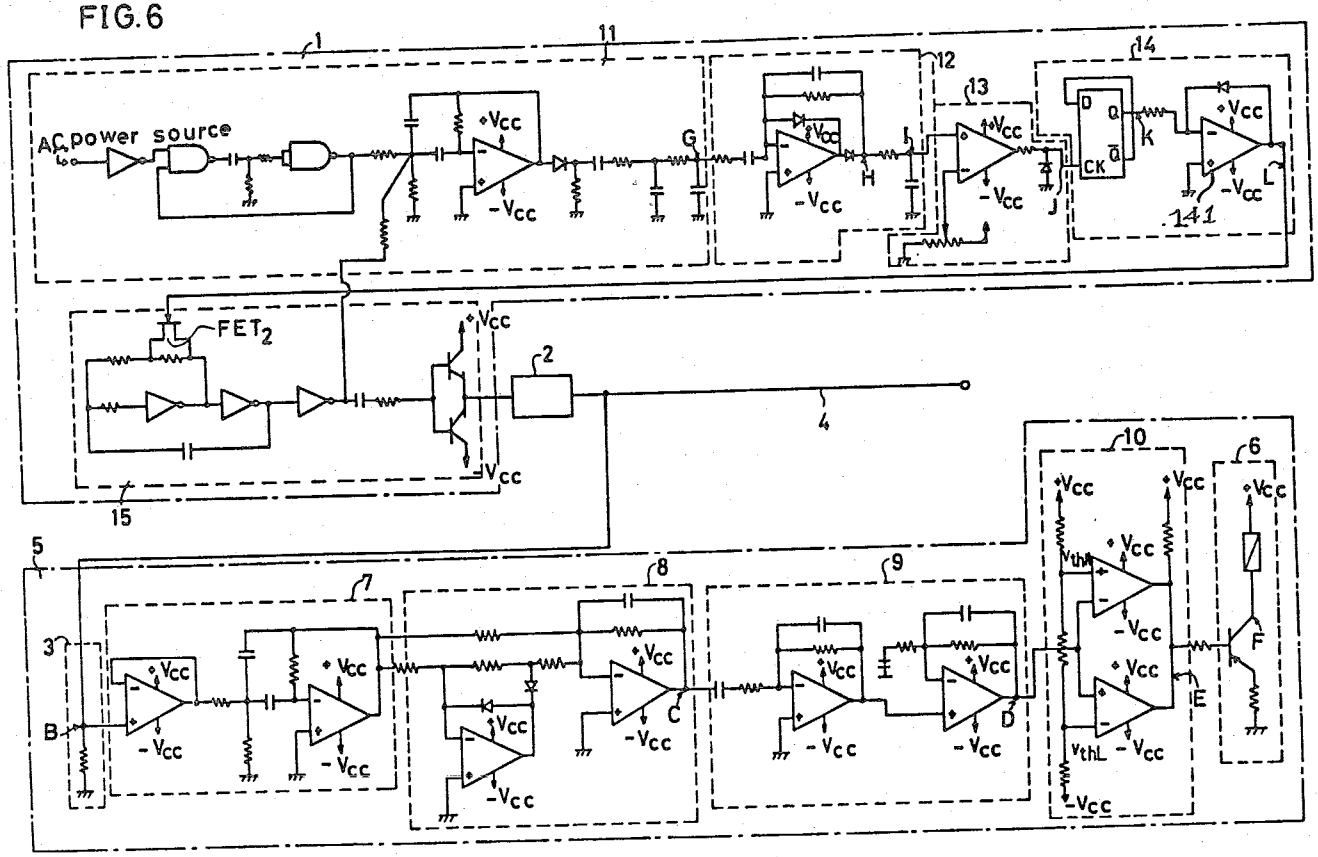
FIG. 6 is a further detailed circuit diagram of the example circuit of FIG. 3(*a*) with the oscillator 1 shown by FIG. 5.
Figure 7:
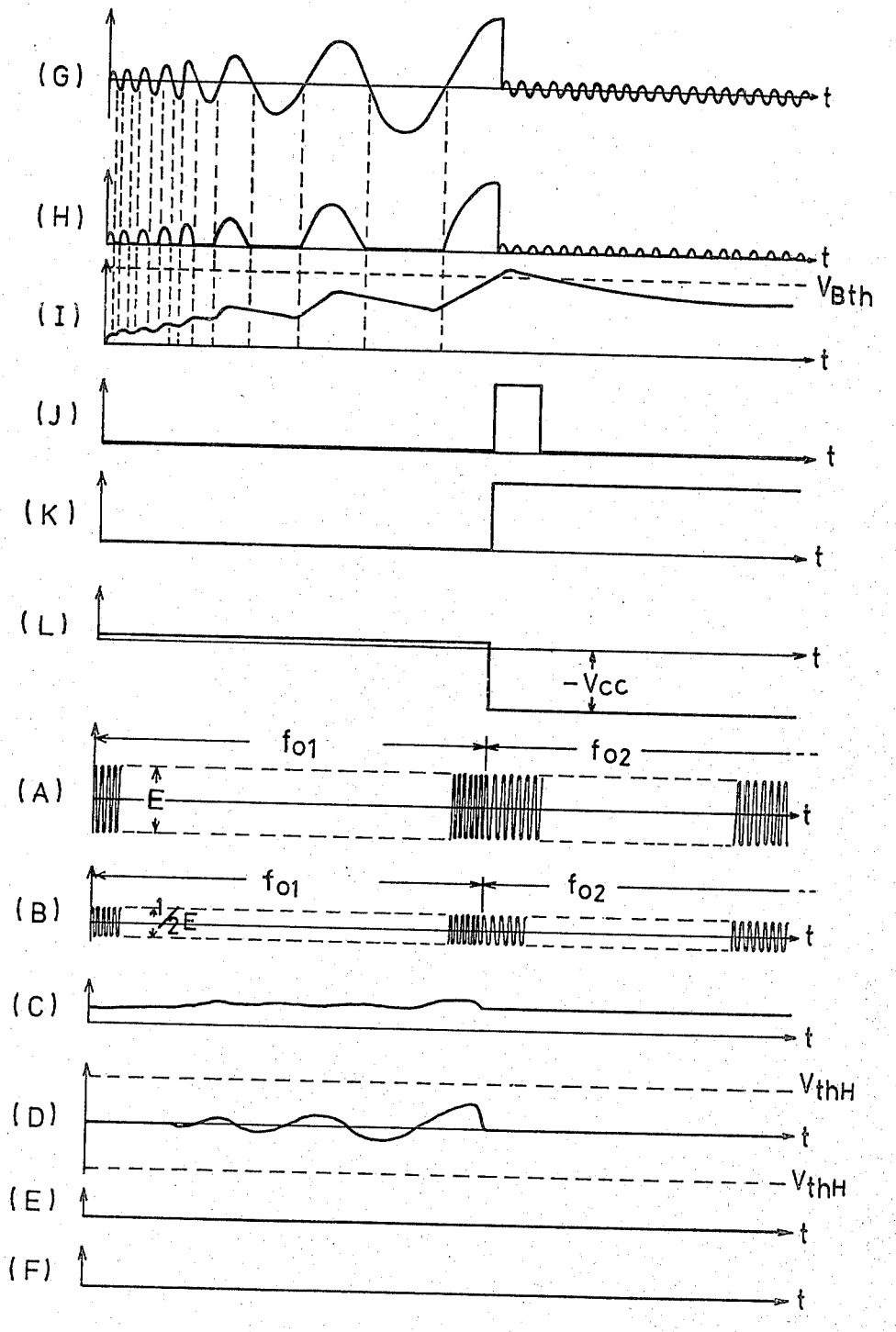
FIG. 7 is a waveform chart showing the waveforms of electric signals at various parts of the system of FIG. 6 for illustrating the beat-eliminating action.

The operation of the circuit of FIG. 5 is as follows: When the frequency of the commercial A.C. power source drifts and the beat frequency is gradually lowered, the amplitude of the beat output is gradually increased as shown by the left half part of FIG. 7(G). Then, the output of the beat detector 12, which is an integration of a half-wave-rectified signal shown by FIG. 7(H) gradually increases as shown by FIG. 7(I). Then, at the time when the beat detector output (I) exceeds a predetermined threshold level $V_{Bth}$, the threshold circuit 13 issues a pulse signal as shown by FIG. 7(J), which turns the flip-flop circuit in the frequency switching circuit 14 and makes output voltage of the latter circuit 14 change. Therefore the frequency switching control circuit 14 issues a signal thereafter to the oscillation circuit 15. The detailed circuit construction of the circuit of FIG. 5 is shown in FIG. 6. As shown in FIG. 6, the output of the comparator 141 of the frequency switching control circuit 14 having the waveform of FIG. 7(*k*) is impressed on the gate of FET 2 of the oscillation circuit 15, which is a CR oscillator and changes its output frequency signal to be given to the antenna 4 by means of the change of the voltage impressed on the gate. By means of the frequency switching, the frequency of the high frequency signal oscillated by the oscillation circuit 15 is switched from hitherto frequency of $f_{01}$ to another frequency $f_{02}$ as shown by FIG. 7(A) and by a frequency spectrum chart of FIG. 8, wherein harmonics of the A.C. commercial power frequency which line up on the frequency spectrum chart are shown. The frequencies $f_{01}$ and $f_{02}$ are selected to have a relation defined by the following equation and shown by FIG. 8.

$$|f_{02}-f_{01}|=nf_{AC}+\Delta f \quad (5),$$

wherein n is an arbitrary positive integer, $f_{AC}$ is a frequency of commercial A.C. power, $\Delta f$ is a frequency smaller than $f_{AC}$, for example of the frequency of as 0.4–0.6 times large as $f_{AC}$.

According to the abovementioned selection of $f_{01}$ and $f_{02}$, when either one of the oscillation frequencies $f_{01}$ or $f_{02}$ forms an undesirable beat of a low frequency with a harmonic of the A.C. power, then the other of the oscillation frequency does not produce a noticeable beat of a low frequency. By means of the switching from the frequency $f_{01}$ to the frequency $f_{02}$, the amplitude of the beat becomes small and the beat frequency becomes very high, so that the possibility of a false alarm disappears. At the same time the output of the beat detector 12 becomes small, and hence the output of the threshold circuit 13 becomes small, but the flip-flop retains the same state until another output is given from the threshold circuit 13. That is to say, the example of FIG. 5 and FIG. 6 evades undesirable false warning due to the beat produced by the interference between the A.C. harmonics and the oscillation frequency, by means of switching the oscillation frequency from that which is producing the beat into that which does not produce the beat. When the frequency $f_{02}$ produces another beat with the harmonics of the A.C. frequency, then another pulse is given to the frequency switching control circuit 14 and hence the oscillation circuit 15 is controlled to switch its frequency to the other frequency $f_{01}$.

As already elucidated, the voltage at the output terminal of the amplifier 7 is given to detector 8 of the signal processing circuit 5. The amplitudes of output of the detector 8 and hence the output of the band-pass filter 9 increase as shown by FIG. 7(C) and FIG. 7(D) as the level of the beat becomes high. However, such level change due to the beat does not make the threshold circuit 10 produce the output, since the threshold levels $V_{thH}$ of the threshold circuit 10 are selected not to react with such output from the band-pass filter for the beat. The preferable pass-band of the band-pass filter is empirically found to be 0.08 Hz to 0.3 Hz, whereby an intruder who is about 1.5 m off the antenna can be detected.

Though the measure of the frequency switching is provided in the example of FIGS. 5 and 6, the function of the intruder detection is the same as that of the example of FIG. 3(*a*), function of which has been elucidated referring to FIG. 4. That is, the intruder causes a change of voltage of the antenna 4 and the change is processed by the signal processing circuit 5, wherein when the output of the band-pass filter 9 (downwards) exceeds the predetermined level $V_{thH}$, the threshold circuit 10 triggers the alarm circuit 11.

Figures 9, 10:
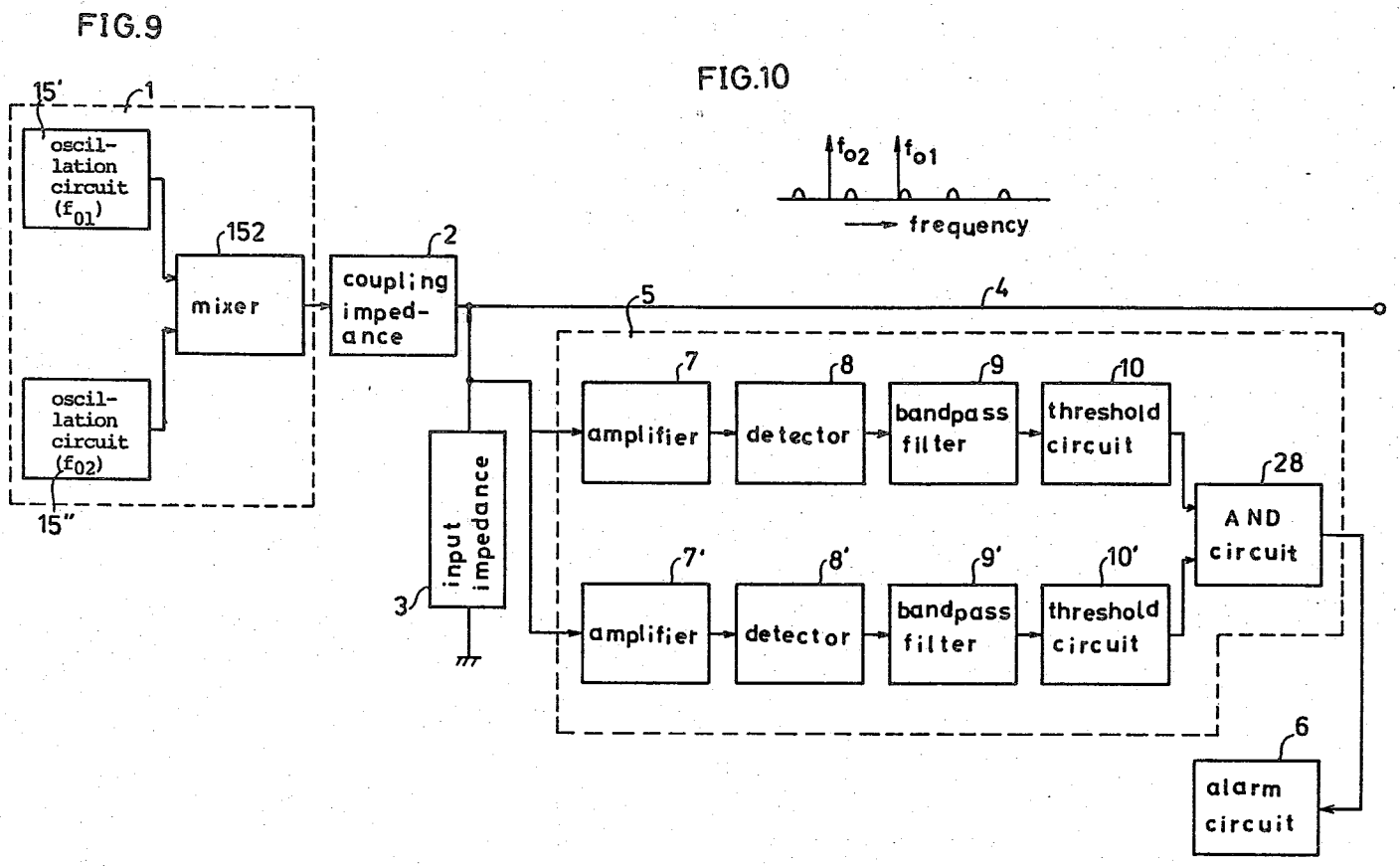
FIG. 9 is a block diagram of a modified example embodying the present invention for eliminating false alarms caused by beating.
FIG. 10 is a frequency spectrum chart for illustrating the beat elimination of FIG. 9.

FIG. 9 shows a block diagram of another example of the present invention, wherein to avoid undesirable false warning due to low frequency beating, a pair of different frequencies $f_{01}$ and $f_{02}$ are always generated by two oscillation circuit 15' and 15'' in the oscillator 1.

The oscillator 1 of FIG. 9 has the two oscillation circuits 15' and 15'' generating frequencies $f_{01}$ and $f_{02}$ and a mixer 152 which adds and feeds the two signals of the $f_{01}$ and $f_{02}$ frequencies, through the coupling impedance 2, to the antenna 4. The signal processing circuit 5 of this example has a pair of tuning amplifiers 7 and 7' of tuning frequencies $f_{01}$ and $f_{02}$, followed respectively by detectors 8 and 8', by band-pass filters 9 and 9', and by threshold circuits 10 and 10'. The output terminals of the threshold circuits 10 and 10' are connected to respective input terminals of an AND circuit 28, which is followed by an alarm circuit 6. The frequencies $f_{01}$ and $f_{02}$ are selected to have a relation defined by the following equation and shown by FIG. 10.

$$|f_{02}-f_{01}|=nf_{AC}+\Delta f \quad (6),$$

wherein n is an arbitrary positive integer, $f_{AC}$ is a frequency of commercial A.C. power, $\Delta f$ is a frequency smaller than $f_{AC}$, for example of the frequency of as 0.4–0.6 times large as $f_{AC}$.

According to the abovementioned section of $f_{01}$ and $f_{02}$, when either one of the oscillation frequencies $f_{01}$ or $f_{02}$ forms an undesirable beat of a low frequency with a harmonic of the A.C. power, then the other of the oscillation frequency does not produce noticeable strong beat of a low frequency. Therefore, even in case of frequency drift which may produce a beat of low frequency with one oscillation frequency, only a single threshold circuit 10 or 10' produces an output, and therefore, the AND circuit 28 does not activate the alarm circuit. On the other hand, when an intruder comes, both band-pass filters 9 and 9' issue output signals to activate both threshold circuits 10 and 10', and therefore, the AND circuit 28 issues an output to the alarm circuit 6 thereby activating it to issue an alarm of intrusion.

Figure 11:
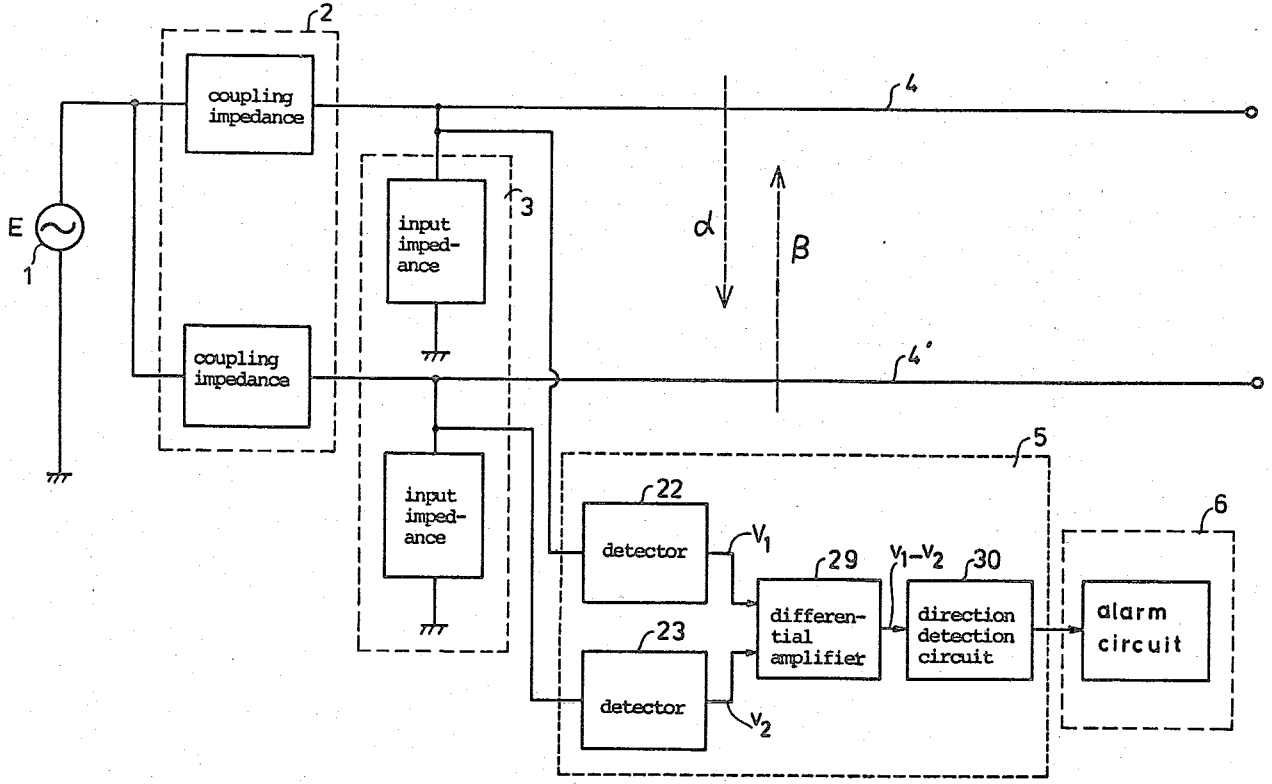
FIG. 11 is a block diagram of a modified example embodying the present invention for detecting the direction of intruders crossing the antennae.
Figure 12:
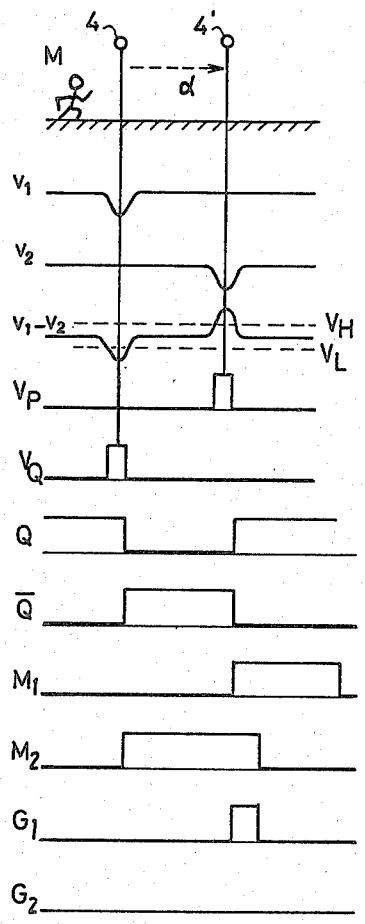
FIG. 12(*a*) and FIG. 12(*b*) are waveform charts of the various parts of the circuit of FIG. 11.
Figure 12:
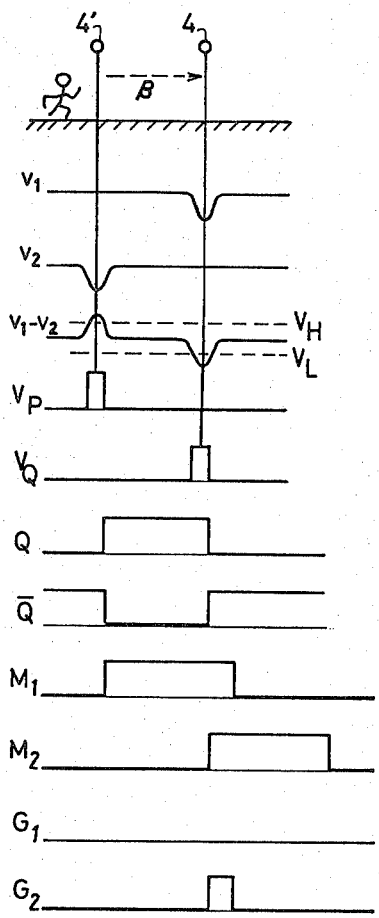
Figure 13:
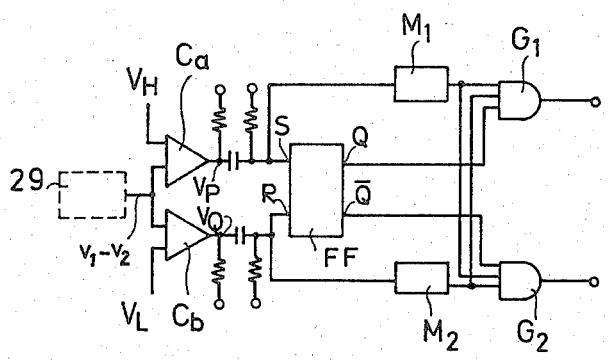
FIG. 13 is a detailed circuit diagram of a direction detection circuit 30 shown in FIG. 11.

FIG. 11, FIG. 12(*a*), FIG. 12(*b*) and FIG. 13 show another example capable of detecting the direction of passage through a protected zone by providing two parallel antennae along it. The circuit shown in FIG. 11 has two parallel antennae 4 and 4' with a predetermined gap. When an intruder comes in the direction shown by a dotted arrow $\alpha$, the antenna 4 first changes its voltage and the other antenna 4' changes its voltage later. Therefore, as shown in FIG. 12(*a*), the first detector 22 outputs a voltage change $v_1$ and the second detector outputs a voltage $v_2$ thereafter. Therefore, a differential amplifier 29, which produces an output of $v_1-v_2$, produce a signal shown as $v_{1-v2}$ of FIG. 12(*a*). Accordingly, in a direction detection circuit 30, details of which are shown in FIG. 13, when the output voltage $v_1-v_2$ from the differential amplifier 29 is higher than a reference voltage $V_H$ as shown in FIG. 12(*a*) the comparator Ca issues the output $V_p$ shown in FIG. 12(*a*), and on the other hand, when the output voltage $v_1-v_2$ from the differential amplifier 29 is lower than reference voltage $V_L$ as shown in FIG. 12(*b*) the comparator Cb issues the output $V_Q$ as shown in FIG. 12(*b*). When the pulse $V_p$ falls down, an RS flip-flop circuit FF is set and issues output pulse Q, and at the same time the monomultivibrator $M_1$ is triggered to issue a pulse $M_1$ of a predetermined time length as shown in FIG. 12(*a*). On the other hand, when the pulse $V_Q$ falls down, the RS flip-flop circuit FF is reset and issues output pulse $\overline{Q}$ and at the same time the monomultivibrator $M_2$ triggered to issue a pulse $M_2$ of a predetermined time length as shown in FIG. 12(*b*). The time length of the pulses $M_1$ and $M_2$ of the monomultivibrators $M_1$ and $M_2$ are selected sufficiently longer than the time required for an intruder to pass the parallel antennae 4, 4'. The AND gate $G_1$ produces AND signal of the $\overline{Q}$ output of the flip-flop FF, $M_1$ and $M_2$ outputs of the monomultivibrators $M_1$ and $M_2$. The AND gate $G_2$ produces AND signal of the Q output of the flip-flop FF, $M_1$ and $M_2$ outputs of the monomultivibrators $M_1$ and $M_2$. Therefore, when the intruder passes the parallel lines in the $\alpha$-direction of FIG. 11, the pulse $V_p$ is issued prior to the pulse $V_Q$, and the gate $G_1$ only issues output to indicate $\alpha$-direction intrusion. On the other hand when the intruder passes the parallel line in the $\beta$-direction of FIG. 11, the pulse $V_Q$ is issued prior to the pulse $V_p$, and the gate $G_2$ only issues output to indicate $\beta$-direction intrusion. This example is very useful since the direction of the man passing the antenna can be detected. In genralizing the idea of this example, by providing a number of pairs of substantially parallel antennae in a protected area, motion of a man in such field can be detected.

Figure 14:
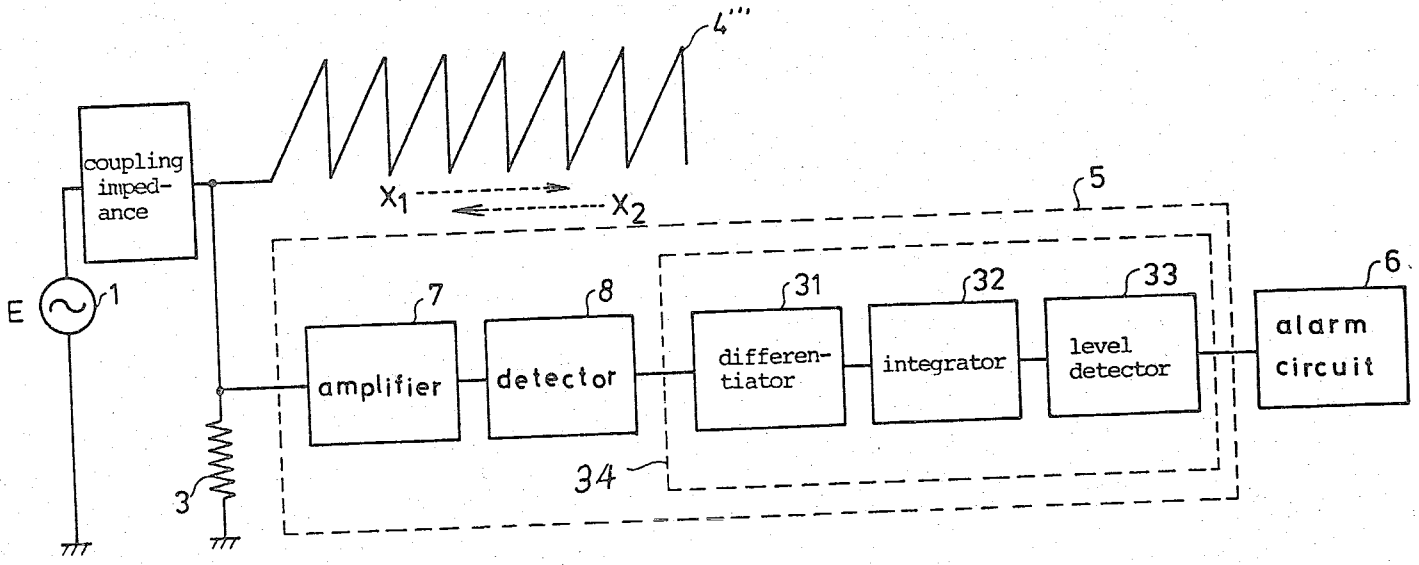
FIG. 14 is a block diagram of another modified example embodying the present invention for detecting the direction of an intruder moving parallel to the antenna.
Figures 15A, 15B:
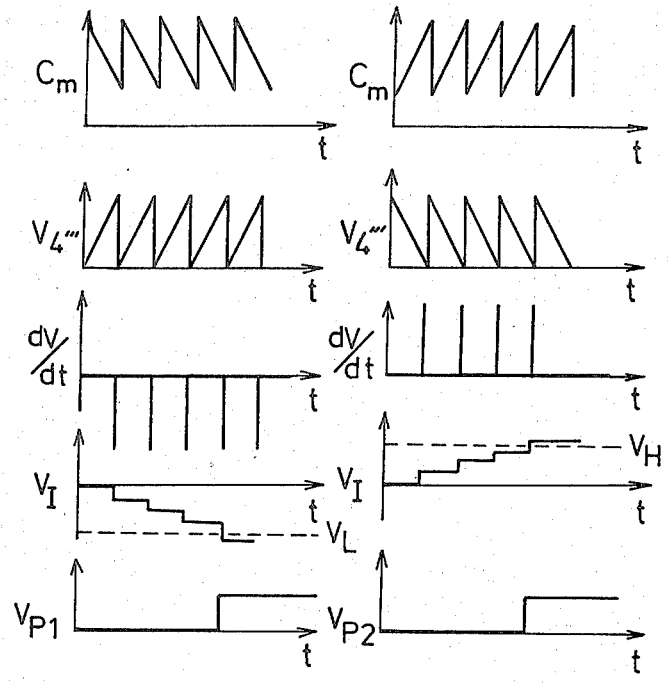
FIG. 15(*a*) and FIG. 15(*b*) are waveform charts of the various parts of the circuit of FIG. 14.
Figure 16:
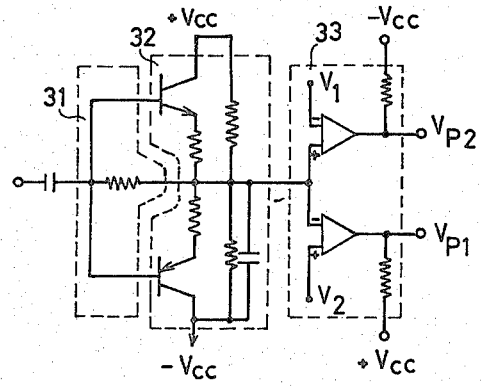
FIG. 16 is a detailed circuit diagram of a differentiator 31, an integrator 32 and a level detector 33 of FIG. 14.

FIG. 14 shows another example capable of detecting motion of the intruder with respect to the lengthwise direction of the antenna. The antenna 4''' is shaped like an saw-tooth waveform, preferably the saw-tooth wave shape should be formed in a substantially vertical plane and the bottom line of the antenna should be formed parallel to the ground. Other parts are substantially the same as any of the foregoing examples, except that a direction detection circuit 34 is connected between the detector 8 and the alarm circuit 6. The direction detecting circuit 34 comprises a differentiator 31, an integrator 32 and a level detector 33. Since the antenna 4''' is saw-teeth shaped as shown by FIG. 14, the capacitance $C_m$ between the antenna 4''' and the human body passing thereunder is as shown in FIG. 15(*a*) and in FIG. 15(*b*) with respect to the lengthwise movement in the direction $X_1$ and $X_2$ along the antenna 4''' represented by the position on the abscissa. Therefore, when the human body moves along the lengthwise direction in $X_1$ and in $X_2$ of the antenna 4''', the voltage $V_{4'''}$ of the antenna and differentiated output thereof dV/dt are as shown by the waveforms $V_{4'''}$ and dV/dt of FIG. 15(*a*) and FIG. 15(*b*), respectively. Therefore, by integrating the outputs of the differentiator 31 by the integrator 32 and inputting integrated output to the level detector 33, the level detector 33 outputs a first output or second output, when the integrated output exceeds predetermined threshold level $V_H$ or $V_L$ of FIG. 15(*a*) or FIG. 15(*b*), respectively. Therefore, by means of the polarity of the outputs of the level detector 33 the direction of the motion of the human body can be detected. FIG. 16 shows a circuit diagram of an example of the direction detection circuit 34 of FIG. 14, and output terminals $V_{p1}$ and $V_{p2}$ are output terminals of the $X_1$-direction movement and $X_2$-direction movement, respectively of the human body under the antenna 4'''. In case detection of movement only along the lengthwise of the antenna irrespective of a direction or an opposite direction thereto, the antenna is sufficient with having symmetrical shape teeth along its length. For example, a symmetrical saw-tooth wave or square wave shape antenna can be used for the detection of such detection.

Figure 17:
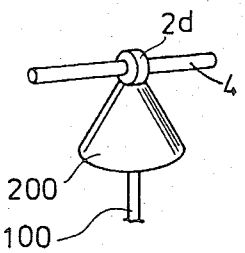
FIG. 17(*a*) is a perspective view of an example of antenna pole cap for eliminating false alarms caused by rain drops on the antenna pole.
Figure 17:
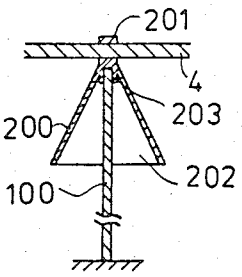
Figure 18:
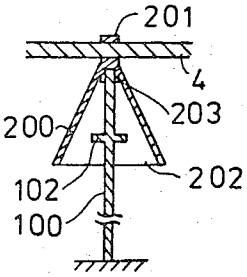
FIG. 18 is a sectional elevation view of another example of an antenna cap.

FIG. 17(*a*) is a perspective view of an example of an antenna pole cap 200 of a conductor substance which covers top part of a pole 100 of an insulating substance which supports the antenna 4. FIG. 17(*b*) is a sectional elevation view of the pole cap 200 of FIG. 17(*a*). The pole cap is made of the conductor substance such as a stainless steel and is shaped substantially in a cone without bottom face. The top part of the cone shape cap 200 has a wire holder 201 for holding the antenna 4 therethrough or thereby. The cone-shaped cap 200 has a vacant open space 202 thereunder which afford a long insulation length for the top part of the pole 100. Since the cap 200 is made of a conductor and is connected to the antenna and protect a considerable length of top part of the pole 100 from attachment of water drops, even a heavy rain does not materially changes the capacitance $C_o$ between the antenna 4 and the ground. Therefore, false alarm, which is hitherto likely to be made by rain drops sticking on the antenna pole forming a conductor to increase the capacitance between the antenna and the ground, can be effectively eliminated. The shape of the cap is preferably conical, since rain drop falls down away from the pole. FIG. 18 is a sectional elevation view of another example wherein a horizontal disk 102 is formed on the pole at the part in the space covered by the cap cone. The disk 102 effectively prevent a rain drop from blowing upward and reaching the top part of the pole 100. By using the abovementioned pole caps on the antenna pole, possibility of false alarm by an undesirable change of the antenna to ground capacitance due to the rain drop is effectively eliminated.

What is claimed is:

1. An intrusion warning system for indicating the presence of an intruder to a given area comprising: comprising:

an antenna provided around said area insulated from the ground;

an oscillator for feeding an alternating current signal to said antenna, said oscillator including a frequency-switchable oscillation circuit which switches the frequency of said alternating current signal in response to a control signal impressed thereon and a beat detection circuit which detects a beat between said alternating current signal and the harmonics of an A.C. power signal adjacent said system, for producing said control signal in response to an occurrence of a beat signal of an amplitude in excess of a predetermined level;

coupling impedance means connected between an output terminal of said oscillator and said antenna; and signal processing means for producing an output signal responding to a change exceeding a predetermined level of the voltage of said alternate current signal on said antenna.

2. An intrusion warning system in accordance with claim 1 wherein:

said frequency-switchable oscillation circuit is switched to oscillatate at either a first oscillation frequency of $f_{01}$ or a second oscillation frequency of $f_{02}$, $f_{01}$ and $f_{02}$ having the relationship of:

$$|f_{02}-f_{01}|=nf_{AC}+\Delta f,$$

where n is an arbitrary positive integer, $f_{AC}$ is a frequency of said A.C. power signal which produces a beat with the signal of said oscillator, and $\Delta f$ is a frequency smaller than $f_{AC}$.

3. An intrusion warning system for indicating the presence of an intruder to a given area comprising:

an antenna providing around said area insulated from the ground, an oscillator for feeding an alternating current signal to said antenna, said oscillator including a first oscillation circuit for generating a first signal having a frequency $f_{01}$ and a second oscillation circuit for generating a second signal having a frequency $f_{02}$, $f_{01}$ and $f_{02}$ having the relation of $$|f_{02}-f_{01}|=nf_{AC}+\Delta f,$$

where n is an arbitrary positive integer, $f_{AC}$ is a frequency of an A.C. power signal adjacent said system which produces a beat with the signal of said oscillator, and $\Delta f$ is a frequency smaller than $f_{AC}$;

coupling impedance means connected between an output terminal of said oscillator and said antenna; and signal processing means for producing an output signal responding to a change exceeding a predetermined level of the voltage of said alternating current signal on said antenna, said signal processing means including signal separation means for separating a first signal of the $f_{01}$ frequency and a second signal of the $f_{02}$ frequency, first means for processing said fist signal and providing an output signal related thereto, second means for processing said second signal and providing an output signal related thereto, and an output circuit which issues an output signal only when both said first means and said second means issue said output signals.

4. An intrusion warning system for indicating the presence of an intruder to a given area comprising:

a first antenna provided around said area insulated from the ground;

a second antenna disposed parallel with said first antenna;

an oscillator for feeding an alternating current signal to said first and second antennas;

first coupling impedance means connected between an output terminal of said oscillator and said first antenna;

second coupling impedance means connected between said output terminal of said oscillator and said second antenna; and signal processing means for producing an output signal responding to a change exceeding a predetermined level of the voltage of said alternating current signal on said antennas, said signal processing means including an order detection circuit for detecting order of occurrence of voltage changes on said first antenna and said second antenna.

5. An intrusion warning system for indicating the presence of an intruder to a given area comprising:

an antenna provided around said area insulated from the ground and shaped into a saw-tooth pattern;

an oscillator for feeding an alternating current signal to said antenna;

coupling impedance means connected between an output terminal of said oscillator and said antenna; and signal processing means for producing an output signal responding to a change exceeding a predetermined level of the voltage of said alternating current signal on said antenna, said signal processing means including a differentiator for differentiating said change of voltage of said antenna thereby to produce a direction signal corresponding to the polarity of the output signal of said differentiator.

6. An intrusion warning system for indicating the presence of an intruder to a given area comprising:

an antenna providing around said area insulated from the ground;

an oscillator for feeding an alternating current signal to said antenna;

coupling impedance means connected between an output terminal of said oscillator and said antenna;

signal processing means for producing an output signal responding to a change exceeding a predetermined level of the voltage of said alternating current signal on said antenna; and an antenna holder pole of an insulating substance having a cap, said cap shaped in a bottom less cone and being made of a conductive substance, said cap having an antenna holding means at the top part and being mounted on said pole by fixing the top end of said pole inside the top end part of said cap.

7. An intrusion warning system in accordance with claim 6 wherein said pole has a substantially horizontal disk in the space covered by said cap.

* * * * *